US005270608A

United States Patent [19]

Williamson et al.

[11] Patent Number: 5,270,608

[45] Date of Patent: Dec. 14, 1993

[54] METAL HALIDE ARC DISCHARGE LAMP ASSEMBLY

[76] Inventors: Glen P. Williamson, 387 Webster St., Manchester, N.H. 03104; Thang T. Tay, 77 Jenkins Rd., Bedford, N.H. 03102

[21] Appl. No.: 786,194

[22] Filed: Oct. 31, 1991

[51] Int. Cl.[5] ..... H01J 61/34

[52] U.S. Cl. ..... 313/25; 313/634

[58] Field of Search ..... 313/25, 634

[56] References Cited

U.S. PATENT DOCUMENTS

| | | | |
|---|---|---|---|
| 4,620,125 | 10/1986 | Keeffe et al. | 313/25 |
| 4,625,141 | 11/1986 | Keeffe et al. | 313/25 |
| 4,961,019 | 10/1990 | White et al. | 313/25 |
| 4,963,790 | 10/1990 | White et al. | 313/25 |
| 5,023,505 | 6/1991 | Ratliff et al. | 313/25 |
| 5,065,069 | 11/1991 | Hunter | 313/25 |
| 5,122,706 | 6/1992 | Parott et al. | 313/25 |
| 5,136,204 | 8/1992 | Muzeroll et al. | 313/25 |

FOREIGN PATENT DOCUMENTS

| | | |
|---|---|---|
| 60-40138 | 9/1985 | Japan . |
| 0737913 | 10/1955 | United Kingdom . |

OTHER PUBLICATIONS

W. M. Keeffe, et al. "Improved Low Wattage Metal Halide Lamp"; pp. 39-43; Summer 1988.

*Primary Examiner*—Donald J. Yusko
*Assistant Examiner*—N. D. Patel
*Attorney, Agent, or Firm*—Joseph S. Romanow; William H. McNeill

[57] ABSTRACT

A metal halide arc discharge lamp includes a sealed lamp envelope, an arc tube located within the lamp envelope, a generally cylindrical, light-transmissive shroud positioned around the arc tube, a frame comprising a single support rod extending between dome and neck regions of the lamp envelope, upper and lower clips for attaching the arc tube and the shroud to the frame, a resilient bulb spacer attached to a neck end of the frame and bearing against an inside surface of the lamp envelope for positioning the frame relative to the lamp envelope, and electrical leads for coupling electrical energy to the arc tube. The frame is mechanically supported within the lamp envelope in the neck region solely by the bulb spacer. Leakage currents between the frame and the electrical leads through the lamp stem are effectively eliminated.

14 Claims, 4 Drawing Sheets

METAL HALIDE ARC DISCHARGE LAMP ASSEMBLY

FIELD OF THE INVENTION

This invention relates to metal halide arc discharge lamps and, more particularly, to arc discharge lamps having improved structures for mounting an arc tube and a shroud within a lamp envelope.

BACKGROUND OF THE INVENTION

Metal halide arc discharge lamps are frequently employed in commercial usage because of their high luminous efficacy and long life. A typical metal halide arc discharge lamp includes a quartz or fused silica arc tube that is hermetically sealed within a borosilicate glass lamp envelope. The arc tube, itself hermetically sealed, has tungsten electrodes attached into opposite ends and contains a fill material including mercury, metal halide additives and a rare gas to facilitate starting. In some cases, particularly in high wattage lamps, the lamp envelope is filled with nitrogen or another inert gas at less than atmospheric pressure. In other cases, particularly in low wattage lamps, the lamp envelope is evacuated.

It has been found desirable to provide metal halide arc discharge lamps with a shroud which comprises a generally cylindrical, light transmissive member, such as quartz, that is able to withstand high operating temperatures. The arc tube and the shroud are coaxially mounted within the lamp envelope with the arc tube located within the shroud. Preferably, the shroud is a tube that is open at both ends. In some cases, the shroud is open at one end and has a domed configuration on the other end. The shroud has several beneficial effects on lamp operation, which are known to those skilled in the art.

Sodium is an important constituent in most high intensity metal halide arc discharge lamps, usually in the form of sodium iodide or sodium bromide. Sodium is used to improve the efficacy and color rendering properties of metal halide lamps. It has long been recognized that arc tubes containing sodium lose sodium during discharge lamp operation. Sodium is lost by the movement, or migration, of sodium ions through the arc tube wall. The iodide originally present in a metal halide lamp as sodium iodide is freed by sodium loss, and the iodide combines with mercury in the arc tube to form mercury iodide. Mercury iodide leads to increased reignition voltages, thereby causing starting and lamp maintenance problems.

A number of designs have been proposed in the prior art for reducing sodium migration from metal halide arc discharge lamps. In U.S. Pat. No. 4,281,274 issued Jul. 28, 1981 to Bechard et al, a shroud is electrically biased with a DC voltage in order to repel positive sodium ions which have migrated through the wall of the arc tube. In a so called "frameless construction" disclosed in U.S. Pat. No. 3,424,935 issued Jan. 28, 1969 to Gungle et al, no frame members are located close to the arc tube. U.S. Pat. Nos. 4,620,125 issued Oct. 28, 1986 to Keeffe et al and 4,625,141 issued Nov. 25, 1986 to Keeffe et al disclose a metal halide arc discharge lamp wherein the metal straps used to support the shroud and the arc tube are electrically connected to an electrical lead of one polarity so that sodium loss from the arc tube is reduced. Other techniques for reducing sodium loss from arc discharge lamps are disclosed by Keeffe et al in *Journal of Illumination Engineering Society,* Summer 1988, pages 39–43; U.S. Pat. No. 4,963,790 issued Oct. 16, 1990 to White et al; Japanese Patent No. 60-40138 published Jul. 30, 1976 and U.S. Pat. No. 4,843,266 issued Jun. 27, 1989 to Santo et al. U.S. Pat. No. 5,023,505, issued Jun. 11, 1991 to Ratliff et al, discloses an arc discharge lamp wherein a support is attached to a lamp stem using a stem clip. U.S. Pat. No. 5,136,204 issued Aug. 4, 1992, discloses a metal halide arc discharge lamp structure including a frame comprising one or two support rods, and upper and lower clips for retaining the shroud and the arc tube. The clips, which are welded to the support rod, prevent both axial and lateral movement of the shroud. The frame is attached to the base end of the lamp by a strap which encircles the lamp stem. Although the lamps disclosed in U.S. Pat. No. 5,156,204 are mechanically strong and are able to survive shipping and handling without significant breakage, these lamps have been found to have a shorter operating life than is known to be achievable. The lamps exhibit changes over life which are indicative of sodium loss.

A further disadvantage of the lamps disclosed in U.S. Pat. No. 5,136,204 is that the neck region of the lamp envelope sometimes contacts the strap which secures the frame to the lamp stem during heat sealing of the lamp envelope to the lamp stem. When this occurs, the lamp envelope must be replaced, thereby increasing manufacturing costs. In addition, the procedure for attaching the strap to the lamp stem during lamp manufacturing is inconvenient and relatively costly.

A metal halide arc discharge lamp wherein the arc tube, shroud and frame are supported by a plurality of resilient springs is disclosed in U.S. Pat. No. 5,065,069, issued Nov. 12, 1991. In the disclosed arc discharge lamp, mechanical connections to the lamp stem are eliminated. Although the disclosed lamp uses bulb spacers at the lower end of the frame, additional angled springs are required to prevent axial movement of the frame relative to the lamp envelope. The additional springs add to the cost and complexity of the lamp. In addition, springs contacting the main portion of the lamp envelope wall are likely to damage any phosphor coating that may be present.

It is a general object of the present invention to provide improved arc discharge lamps.

It is another object of the present invention to provide arc discharge lamps wherein sodium migration from the arc tube is suppressed.

It is a further object of the present invention to provide arc discharge lamps which are capable of withstanding mechanical shock and vibration.

It is still another object of the present invention to provide arc discharge lamps which have long operating lives.

It is another object of the present invention to provide arc discharge lamps wherein leakage current between a support frame and electrical inleads is effectively eliminated.

It is a further object of the present invention to provide arc discharge lamps which are simple in construction, easy to manufacture and low in cost.

SUMMARY OF THE INVENTION

According to the present invention, these and other objects and advantages are achieved in an electric lamp comprising a sealed lamp envelope and a lamp subassembly located within the lamp envelope. The lamp subassembly includes an arc tube for generating light when electrical energy is applied thereto, a generally cylindrical, light-transmissive shroud disposed around the arc tube, a frame comprising a single support rod extending between dome and neck regions of the lamp envelope, means for attaching the arc tube and the shroud to the frame, and a resilient bulb spacer attached to a neck end of the frame and bearing against an inside surface of the lamp envelope in the neck region for positioning the frame relative to the lamp envelope. A dome end of the frame engages an inward projection in the dome region of the lamp envelope. The electric lamp further includes electrical leads for coupling electrical energy through the lamp stem to the arc tube. The lamp subassembly is mechanically supported within the lamp envelope solely by the dome end of the frame, the bulb spacer and the electrical leads.

The bulb spacer preferably comprises a generally C-shaped resilient metal strip having a gap to permit compression and expansion during installation of the lamp subassembly in the lamp envelope. The bulb spacer can include a recess for receiving the frame and for locating the frame relative to the bulb spacer. The bulb spacer contacts the inside surface of the lamp envelope with sufficient frictional force to prevent axial or lateral movement of the lamp subassembly relative to the lamp envelope.

The bulb spacer and the frame are mechanically and electrically isolated from the lamp stem. As a result, leakage current to the electrical leads is effectively eliminated, and sodium migration from the arc tube is suppressed. In addition, the lamp manufacturing process is simplified in comparison with prior art metal halide arc discharge lamps.

BRIEF DESCRIPTION OF THE DRAWINGS

For a better understanding of the present invention, together with other and further objects, advantages and capabilities thereof, reference is made to the accompanying drawings which are incorporated herein by reference and in which.

DESCRIPTION OF THE PRIOR ART

Figure 1:
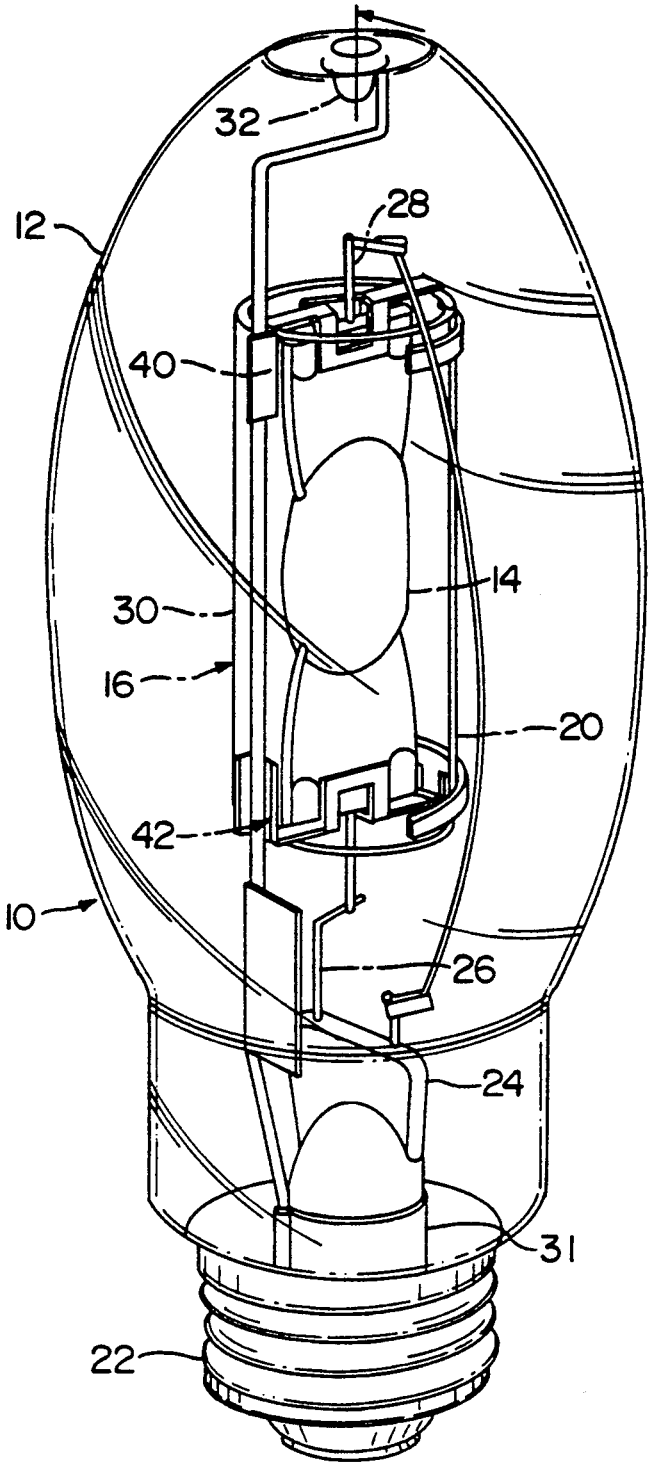
FIG. 1 PRIOR ART
FIG. 1 is a perspective view of a metal halide arc discharge lamp in accordance with the prior art.

An electric lamp 10 in accordance with the prior art is shown in FIG. 1. The lamp 10 includes a lamp envelope 12 and an arc tube 14 mounted within lamp envelope 12 by a mounting means 16. The arc tube 14 is positioned within a shroud 20. The shroud 20 is supported in the lamp 10 by the mounting means 16. Electrical energy is coupled to the arc tube 14 through a base 22, a lamp stem 24 and electrical leads 26 and 28. The arc tube 14 is typically a metal halide arc discharge tube. The shroud 20 comprises a cylindrical tube of light transmissive, heat resistant material such as quartz.

The mounting means 16 supports both the arc tube 14 and the shroud 20 within the lamp envelope 12. The mounting means 16 includes a metal support rod 30 attached to lamp stem 24 by a strap 31. The support rod 30 engages an inward projection 32 in the upper end of the lamp envelope 12. The support rod 30 in its central portion is parallel to a central axis of arc tube 14 and shroud 20. The mounting means 16 further includes an upper clip 40 and a lower clip 42 which secure both arc tube 14 and shroud 20 to support rod 30. The clips 40 and 42 are attached to support rod 30, preferably by welding.

DETAILED DESCRIPTION OF THE INVENTION

Figure 2A:
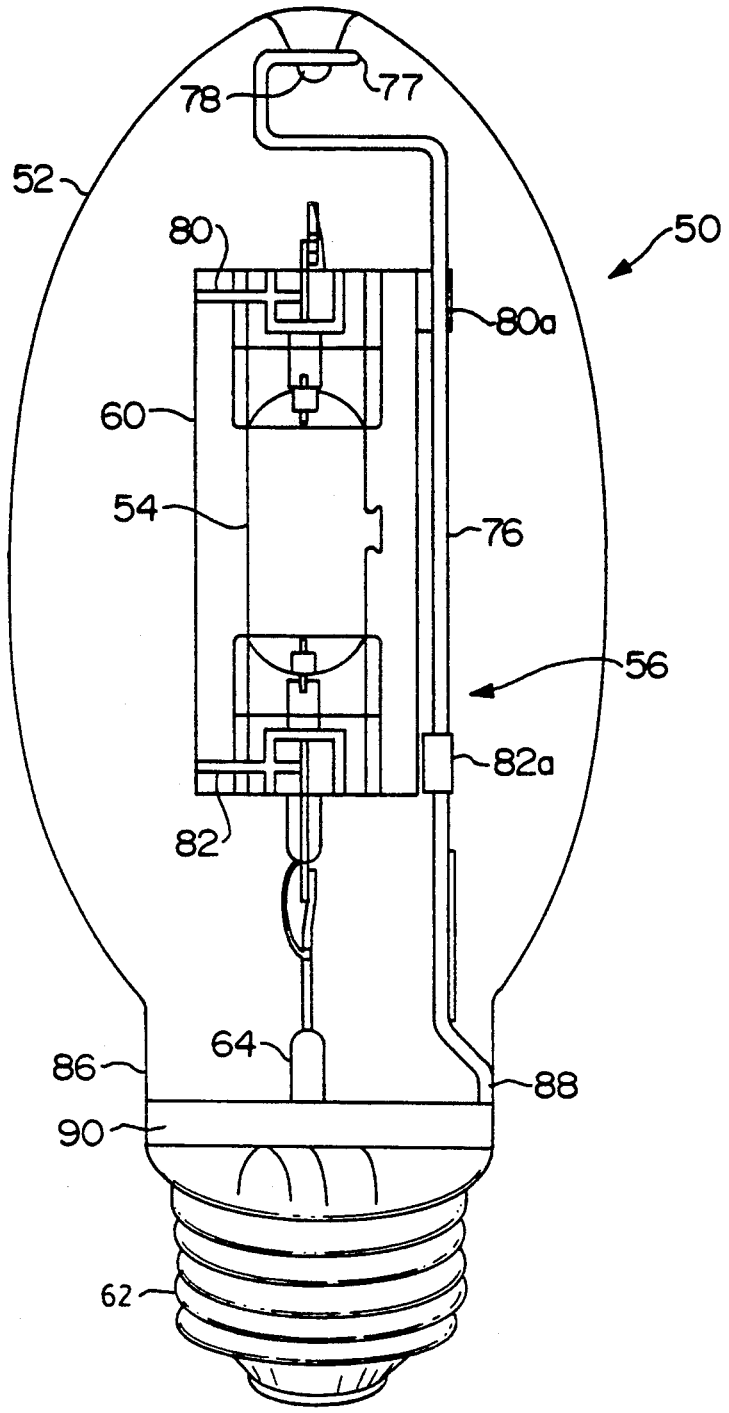
FIGS. 2A and 2B are front and side elevation views, respectively, of a metal halide arc discharge lamp in accordance with the present invention.
Figure 2B:
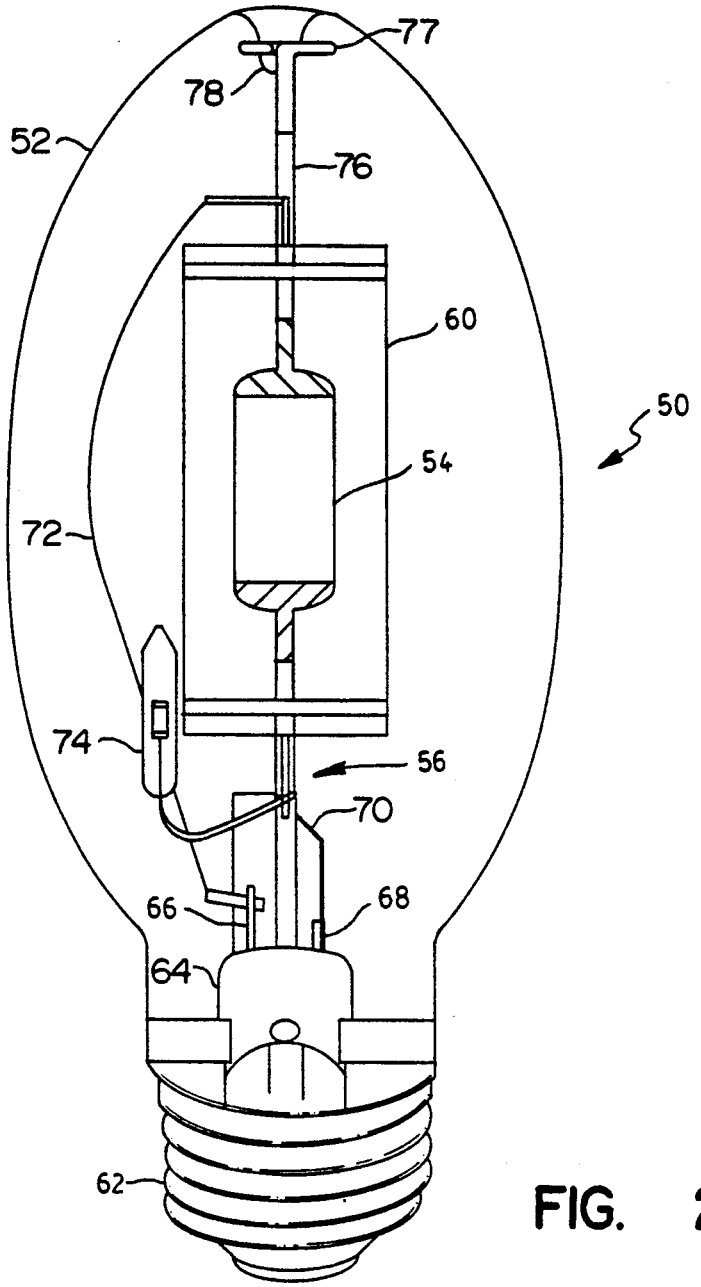

A metal halide arc discharge lamp 50 in accordance with a preferred embodiment of the present invention is shown in FIGS. 2A and 2B. The lamp 50 includes a lamp envelope 52 and an arc tube 54 mounted within lamp envelope 52 by a mounting structure 56. The arc tube 54 is positioned within a shroud 60. The shroud 60 is supported in the lamp envelope 52 by the mounting structure 56.

Electrical energy is coupled to arc tube 54 through a base 62 and a lamp stem 64. The lamp stem 64 includes a flared portion that is sealed to lamp envelope 52. Electrical inleads 66 and 68 are sealed into lamp stem 64. Inlead 68 is electrically connected to one electrode of arc tube 54 by a conductor 70, and inlead 66 is electrically connected to the other electrode of arc tube 54 by conductor 72. A starting device 74, glow bottle, is connected to conductor 70.

The mounting structure 56 mechanically supports both the arc tube 54 and the shroud 60 within lamp envelope 52. The mounting structure 56 secures arc tube 54 and shroud 60 in fixed position so that they cannot move axially or laterally relative to the lamp envelope 52 during shipping and handling or during operation. The mounting structure 56 includes a frame comprising a metal support rod 76 having a central portion that is parallel to a central axis of arc tube 54 and shroud 60. A dome end 77 of support rod 76 engages a projection 78 in the dome end of lamp envelope 52. The projection 78 extends inwardly from the dome end of lamp envelope 52 and is located on a central axis of lamp envelope 52. The dome end 77 of support rod 76 is formed into a generally circular shape that is dimensioned for receiving projection 78.

The mounting structure 56 further includes an upper clip 80 and a lower clip 82 which secure both arc tube 54 and shroud 60 to support rod 76. The clips 80 and 82 include tabs **80*a* and 82*a*, respectively, which are attached to support rod 76, preferably by welding. Further details regarding the clips 80 and 82** are provided in the aforementioned U.S. Pat. No. 5,136,204, which is hereby incorporated by reference. Other clip and strap arrangements for attaching an arc tube and a shroud to a support rod are known to those skilled in the art.

The lamp envelope 52 includes a neck region 86 having a smaller diameter than the main portion of the lamp envelope 52. A neck end 88 of support rod 76 is attached to a bulb spacer 90. The bulb spacer 90 comprises a strip of resilient, heat resistant material that bears against the inside surface of lamp envelope 52 in neck region 86 and retains the lower end of support rod 76 in a fixed position. A portion of support rod 76 adjacent to neck end 88 is typically angled outwardly toward lamp envelope 52 for attachment to bulb spacer 90. The bulb spacer 90 positions support rod 76 such that arc tube 54 and shroud 60 are centered within lamp envelope 52.

Figure 3:
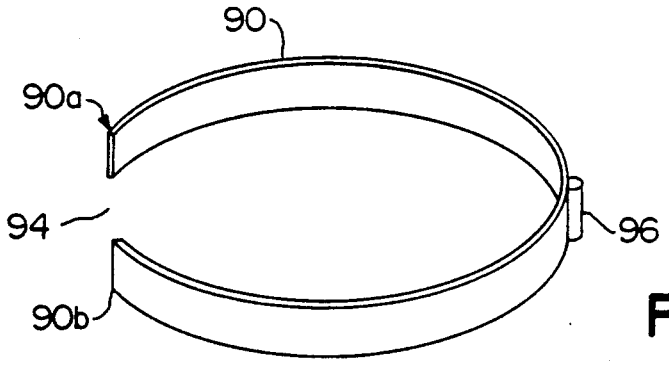
FIG. 3 is a perspective view of the bulb spacer used in the arc discharge lamp of FIGS. 2A and 2B.

A preferred embodiment of the bulb spacer 90 is shown in FIG. 3. A strip of resilient, spring-like material such as stainless steel is formed into a generally C shaped configuration. Preferably, the resilient strip has a width in the range of about 0.125 inch to 0.250 inch and a thickness of about 0.010 inch to 0.020 inch when stainless steel is used. The bulb spacer 90 has a generally circular configuration with a gap 94 to permit compression and expansion of the bulb spacer during its installation in lamp envelope 52. In a preferred embodiment, the bulb spacer 90 comprises about 75% to 80% of a complete circle. The bulb spacer 90 is preferably provided with a recess 96 for engaging support rod 76. The recess 96 is preferably located midway between ends 90*a* and 90*b* of bulb spacer 90 and is formed as a radius that matches the radius of support rod 76. The recess 96 insures that the support rod 76 is attached to the midpoint of bulb spacer 90 and assists in maintaining bulb spacer 90 perpendicular to support rod 76.

Figure 4:
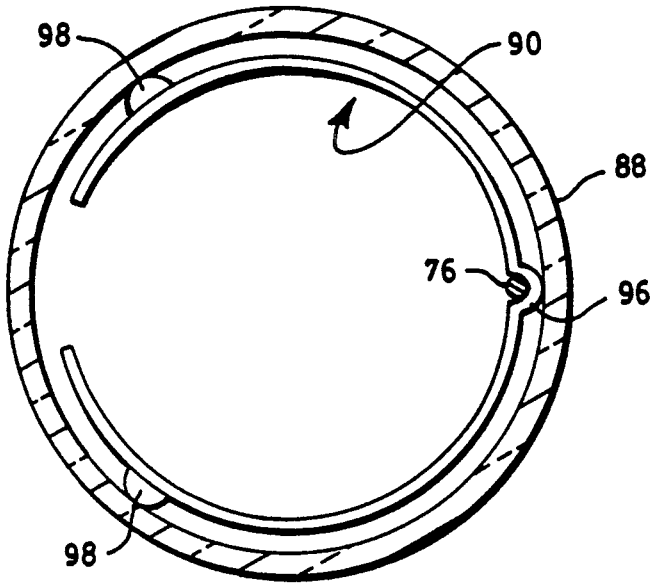
FIG. 4 is a sectional view through the neck of a lamp illustrating an alternate embodiment of the invention.

It will be understood that other configurations of the bulb spacer are included within the scope of the present invention. For example, the resilient metal strip that forms bulb spacer 90 can provided with outward projections, or dimples 98, as shown in FIG. 4, for contacting the inside surface of lamp envelope 52. The bulb spacer can be shaped for three point contact with the inside surface of lamp envelope 52. In general, the requirements on the bulb spacer 90 are to locate the lower end of support rod 76 with respect to lamp envelope 52 and to provide frictional engagement with lamp envelope 52 without attaching the support rod 76 to the lamp stem 64.

A lamp subassembly including arc tube 54, shroud 60, clips 80 and 82, support rod 76 and bulb spacer 90 is mechanically supported within lamp envelope 52 at its upper end by the engagement of dome end 77 with projection 78 and at its lower end by the engagement of bulb spacer 90 with the inside surface of lamp envelope 52. In addition, the electrical conductors 70 and 72 provide some minimal mechanical support of the lamp subassembly. In the configuration of FIGS. 2A and 2B, the support rod 76 and bulb spacer 90 are mechanically and electrically isolated from lamp stem 64, since bulb spacer 90 encircles lamp stem 64 but is spaced from it by approximately one half inch. Thus, the problem of leakage currents between the support rod 76 and the electrical inleads 66 and 68 is effectively eliminated. Furthermore, since a strap around the lamp stem 64 is not utilized, the problem of contact between lamp envelope 52 and the strap during the sealing process is eliminated.

Assembly of the lamp shown in FIGS. 2A and 2B and described above is easier and safer than assembly of the prior art lamp shown in FIG. 1. The lamp of the present invention requires only a single weld between the support rod 76 and the bulb spacer 90. In the prior art lamp shown in FIG. 1, the manufacturing process for attachment of the strap to the lamp stem was relatively difficult and required several steps.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An electric lamp comprising:

a sealed lamp envelope including a dome region having an inward projection and a neck region sealed to a lamp stem;

a lamp subassembly located within said lamp envelope, said lamp subassembly including an arc tube for generating light when electrical energy is applied thereto, a generally cylindrical, light-transmissive shroud disposed about said arc tube, a frame comprising a single support rod extending between the dome and neck regions of said lamp envelope along one side only of said subassembly, a dome end of said frame engaging the inward projection of said lamp envelope, means for attaching said arc tube and said shroud to said frame, and a bulb spacer attached to a neck end of said frame and bearing against an inside surface of said lamp envelope in the neck region for positioning said frame relative to said lamp envelope; and electrical leads for coupling electrical energy through said lamp stem to said arc tube, said electrical leads and said lamp stem being electrically isolated from said frame, said lamp subassembly being mechanically supported within said lamp envelope solely by the dome end of said frame, said bulb spacer and said leads.

2. The electric lamp of claim 1 wherein said bulb spacer comprises a generally C-shaped resilient metal strip.

3. The electric lamp of claim 2 wherein said resilient metal strip includes a plurality of dimples for contacting the inside surface of said lamp envelope.

4. The electric lamp of claim 1 wherein said bulb spacer comprises a resilient metal strip formed into a generally circular shape having a gap to permit compression and expansion during installation of said lamp subassembly in said lamp envelope.

5. The electric lamp of claim 1 wherein said bulb spacer comprises a resilient metal strip having a recess for receiving said support rod of said frame and for locating said frame relative to said bulb spacer.

6. The electric lamp of claim 1 wherein said support rod of said frame is angled outwardly in the neck region of said lamp envelope relative to a central axis of said lamp envelope for attachment to said bulb spacer.

7. The electric lamp of claim 1 wherein said bulb spacer contacts the inside surface of said lamp envelope with sufficient frictional force to prevent axial movement of said lamp subassembly relative to said lamp envelope.

8. The electric lamp of claim 1 wherein said frame and said bulb spacer are mechanically and electrically isolated from said lamp stem.

9. The electric lamp of claim 1 wherein said arc tube comprises a metal halide arc discharge tube containing a source of sodium ion.

10. The electric lamp of claim 1 wherein said means for attaching said arc tube and said shroud to said frame comprises upper and lower clips attached to opposite ends of said arc tube and retaining said shroud between them.

11. A metal halide arc discharge lamp comprising;

a sealed lamp envelope including a dome region having an inward projection and a neck region sealed to a lamp stem;

a metal halide arc tube located in said lamp envelope for generating light when electrical energy is applied thereto;

a generally cylindrical, light-transmissive shroud disposed around said arc tube;

a frame comprising a single support rod extending between the dome and neck regions of said lamp envelope along one side only of said shroud, a dome end of said frame engaging the inward projection of said lamp envelope;

means for attaching said arc tube and said shroud to said frame;

a resilient bulb spacer attached to a neck end of said frame and bearing against an inside surface of said lamp envelope in the neck region for positioning said frame relative to said lamp envelope; and electrical leads for coupling electrical energy through said lamp stem to said arc tube, said electrical leads and said lamp stem being electrically isolated from said frame, said frame being mechanically supported in the neck region of said lamp envelope solely by said bulb spacer.

12. A metal halide arc discharge lamp as defined in claim 11 wherein said bulb spacer comprises a generally C-shaped, resilient metal strip having a recess for receiving said support rod of said frame and for locating said support rod of said frame relative to said bulb spacer.

13. The metal halide arc discharge lamp of claim 12 wherein said bulb spacer contacts the inside surface of said lamp envelope with sufficient frictional force to prevent axial movement of said frame relative to said lamp envelope.

14. The metal halide arc discharge lamp of claim 13 wherein said means for attaching said arc tube and said shroud to said frame comprises upper and lower clips attached opposite ends of said arc tube and retaining said shroud between them.

* * * * *